US011028576B1

(12) United States Patent
Stecker, Sr.

(10) Patent No.: US 11,028,576 B1
(45) Date of Patent: Jun. 8, 2021

(54) LIFT AND FILL CONCRETE RAISING SYSTEM

(71) Applicant: David W. Stecker, Sr., Schaumburg, IL (US)

(72) Inventor: David W. Stecker, Sr., Schaumburg, IL (US)

( * ) Notice: Subject to any disclaimer, the term of this patent is extended or adjusted under 35 U.S.C. 154(b) by 85 days.

(21) Appl. No.: 16/208,520

(22) Filed: Dec. 3, 2018

Related U.S. Application Data

(60) Provisional application No. 62/593,982, filed on Dec. 3, 2017.

(51) Int. Cl.
*B25B 1/00* (2006.01)
*E04B 1/35* (2006.01)
*B66F 3/08* (2006.01)

(52) U.S. Cl.
CPC ..... *E04B 1/3511* (2013.01); *B66F 3/08* (2013.01)

(58) Field of Classification Search
CPC ..... E04B 1/3511; B66F 3/08
USPC ..... 269/3; 254/2 R, 89 R, 4 R, 10 R, 93 H
See application file for complete search history.

(56) References Cited

U.S. PATENT DOCUMENTS

D378,457 S * 3/1997 Page ..... A61G 7/1042 D34/28
7,207,612 B2 * 4/2007 Raney ..... B66C 1/422 294/110.1
8,099,806 B2 * 1/2012 Chepurny ..... A61G 7/1042 5/81.1 R
8,793,822 B2 * 8/2014 Martin ..... A61G 7/1019 5/81.1 R
2002/0043137 A1 * 4/2002 Yeo ..... B66F 7/26 82/112
2010/0264384 A1 * 10/2010 Realegeno-Amaya ..... B66D 1/08 254/2 R

* cited by examiner

*Primary Examiner* — Orlando E Aviles
*Assistant Examiner* — Jonathan G Santiago Martinez
(74) *Attorney, Agent, or Firm* — Chicago IP Law; Steven M. Evans

(57) ABSTRACT

A system to lift concrete slabs, objects or other rigid materials comprising a sway and lifting bar, lifting jacks on opposing ends of the sway and lifting bar, slip lifting tube brackets on opposing ends of the sway and lifting bar, and a lifting bracket attached to each slip lifting tube bracket by a chain at opposing ends of the sway and lifting bar.

19 Claims, 7 Drawing Sheets

LIFT AND FILL CONCRETE RAISING SYSTEM

CROSS-REFERENCE TO RELATED APPLICATIONS

This patent application claims priority to provisional patent applications entitled "Lift and Fill Concrete Raising System" filed on Dec. 3, 2017, having application No. 62/593,982, which is hereby incorporated by reference.

BACKGROUND OF THE INVENTION

Field of the Invention

The present invention relates generally to concrete raising devices, such as for a sunken sidewalk, and more particularly, to concrete raising systems that utilize lifting jacks.

Description of Related Art

Current cement lifting systems are very expensive to purchase and operate. An operator of a conventional cement lifting system, such are for raising a sunken sidewalk, requires a lot of skill and training to operate the conventional cement raising equipment and must know where to drill holes to inject the material in order to lift the concrete to the proper position. The resulting drill holes are ugly to look at. It is also easy to make a mistake and no way to remove the material once it is injected. Thus, a lot of equipment and skilled labor is required with conventional systems.

For example, using conventional concrete raising systems that inject mud below the concrete through drill holes to raise the concrete, an operator needs a hydraulic mud pump, a gas hammer drill and bit, a concrete saw, a mortar mixer, shovels, a garden hose, and a dump truck or a pick up truck and a trailer. An operator also must also clean up resulting mud, cement, and fill the drill holes.

With a conventional foam concrete raising system, wherein foam is injected through smaller drills holes in the concrete, an operator needs an electric hammer drill, a generator, an air compressor, a concrete saw, a two-part foam machine, a box truck or an enclosed trailer, and vehicle to tow trailer. Skilled labor also is required. The drill holes are smaller than holes drilled through the top of the concrete, but the resulting drill holes are still ugly, and the operator has to clean the equipment after each use.

Accordingly, there is a need for an easier to operate concrete raising system that results in unsightly drill holes and is more economically and less time consuming to operate and clean after use.

ASPECTS AND SUMMARY OF THE PRESENT INVENTION

One aspect of the present invention is to provide a concrete raising system that is easier to operate and does not require highly skilled labor.

Another aspect of the present invention is to provide a concrete raising system that does not leave unsightly drill holes in the concrete after raising sunken concrete.

A further aspect of the present invention is to provide a concrete raising system that is more economical to use.

Another aspect of the present invention is to provide a concrete raising system that does not require a lot of clean up after completion of a job.

In order to achieve these aspects and others, the present invention provides a concrete lift and fill system that is easier to operate and more economical to use. The invention facilitates the lifting of settled concrete slabs or other objects and safely suspending them. The present invention facilitates the ability to return concrete slabs or other objects to there original position or grade, or to change the position or grade before any support material is added.

The present invention facilitates the installation and curing of support material that will be poured, pumped or injected into the void under a concrete slab or other objects, that are suspended by the lift. After the present invention has been located into the desired position, the present invention can be used to lift curbs, sidewalks, patios, driveways, retaining walls, statues, paving stones, steel plates, and the like.

The present invention facilitates the ability to lift objects that may be stuck in the dirt so that other equipment may pick them up and move them, such as a tractor with forks could pick up a steel plate.

The present invention facilitates the ability to do repairs under a concrete slab or object. For example, if a repair needs to be done under a sidewalk or a tree root needs to be removed that is supporting the concrete underneath, the slab of concrete sidewalk could be saw-cut at the joints on each side and lifted up. Several pieces of round pipe are placed under the slab and the slab could be rolled out of the way. The repair could be completed and the slab of sidewalk rolled back into place and lifted into position & base material installed. This would eliminate the cost and the need for breaking up a section of the concrete sidewalk and pouring a new one.

The present invention facilitates the ability to lift a concrete slab or other objects off the ground so that electrical cables, wires, lines, and the like can be placed underneath and the concrete slab and lowered back into its original position. Such a process is much easier than having to dig under the slab or drive a pipe under and across.

The present invention provides two jack setups, two slip tube lifting brackets with pivoting lift ring, two lifting brackets with chain nuts and bolts, a digging shovel, and a hammer. One piece of tubing or solid bar that is rated for the weight load that is being lifted, and long enough to span past the edge of the concrete being lifted, is used as the sway and lifting tube. A few cans of expandable foam also is needed, such as Dow Great Stuff large gap filler, and a small roll of plastic tubing to slide over the tube on the can of expandable foam which can be purchased at most hardware stores or lumberyards. A concrete saw and hammer drill, are rarely needed and can be rented or purchased if necessary.

The foregoing has outlined, rather broadly, the preferred features of the present invention so that those skilled in the art may better understand the detailed description of the invention that follows. Additional features of the invention will be described hereinafter that form the subject of the claims of the invention. Those skilled in the art should appreciate that they can readily use the disclosed invention and specific embodiments as a basis for designing or modifying other structures for carrying out the same purposes of the present invention, and that such other structures do not depart from the spirit and scope of the invention in its broadest form.

DETAILED DESCRIPTION OF THE PREFERRED EMBODIMENT

Figure 1:
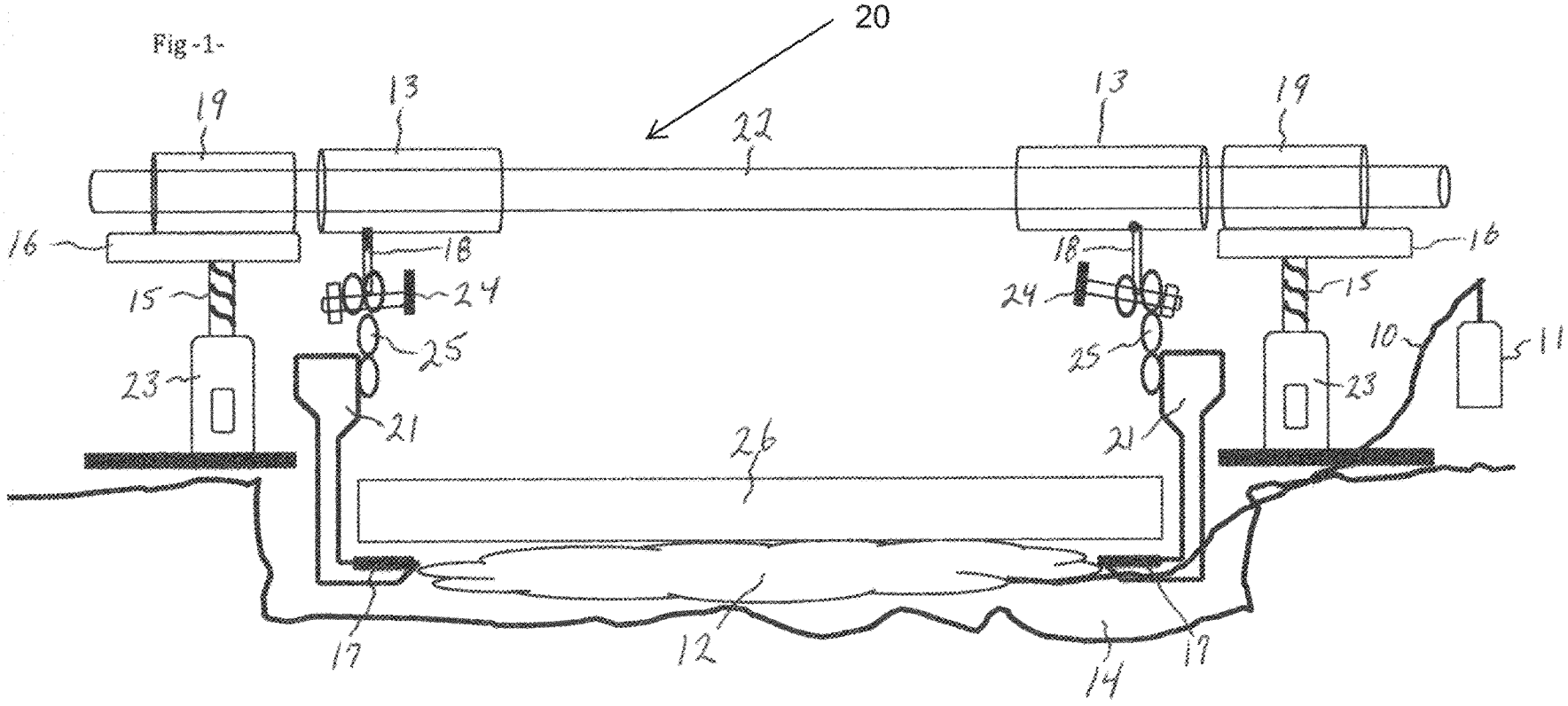
FIG. 1 is a side view of a cement raising system for lifting opposing sides of a cement block configured in accordance with the present invention.

Referring now to the drawings, FIG. 1 illustrates a side view of a concrete raising system 20 configured in accordance with the present invention. Illustrated is the concrete raising system 20 uplifting and suspending of a slab of concrete 26 with foam 12 support material using the concrete raising system 20 of the present invention. The concrete raising system of the present invention comprises two opposing air or hydraulic bottle jacks 23 with slip tubes 19 that each preferably are 5 inches long, 2.5 inches in diameter, and has 3/16 inch walls. The slip tubes 19 preferably each are welded to three inch widexseven inch long and ½" thick steel plate 16 with rounded corners. The steel plate 16 functions as a saddle or mounting support for the steel slip tubing 19. Each saddle 16 is welded to the extension screw 15 of a jack 23. The slip tube 19 can be round, square, or any cross-section configuration.

The slip tube 19 being welded to the saddle 16, which is secured to the extension screw 15, has multiple functions. One function of the slip tube 19 being secured to the screw 15 via the saddle 16 is to provide height adjustment. The second function of the slip tube 19 being welded to the screw 15 via the saddle 16 is to provided a 360° turn radius or easy alignment of the sway and lifting tube 22, which preferably is two inches in diameter. The third function of the slip tube 19 being welded to the screw 15 via the saddle 16 is to keep the sway and lifting tube 22 in position on the saddle 16 and allows the sway and lifting tube 22 to adjust itself as the jacks 23 are raised. The sway and lifting tube 22 preferably has a wall thickness of at least ¼ an inch and preferably is long enough to span past the concrete slab 26 by a minimum of ten inches on each side of the concrete slab 26. The slip tube 19 is slightly larger in diameter than the sway and lifting tube 22, which is made of steel, wood or any other material suitable for the material supporting a concrete slap being lifted.

The slip tube 19 welded on the saddle 16 preferably is square in cross-section and made of steel or any other suitable material. The square tubing 19 accommodates various geometric shaped tubing or solid bars for the sway and lifting tube or bar 22. The slip tube 19 secured on the saddle 16 can be of any geometric shape tubing. The sway and lifting tube 22 supports two lifting tubes or bracket 13 on opposing ends of the sway and lifting tube 22.

The lifting tubes 13 have pivoting lift rings 18 secured to the bottom of the lifting tubes. Each pivoting ring 18 is preferably constructed of steel and welded to a lifting tube 13. The pivoting rings 18 enable lifting brackets 21 to be easy adjusted and aligned for lifting a concrete slab 26. Each lifting bracket 21 has a lifting platform 17 for locating a concrete slab 26 on to lift the concrete slab 26.

A steel chain 25 is welded to each lifting bracket 21, and a steel pivoting lift ring 18 is welded to each lifting bracket or tube 13. A steel bolt 24 is inserted through the chain 25 and secured with a nut on each side of the pivoting lift rings 18. The lifting tubes 13 preferably have a 2.5 inch outer diameter and preferably have a 3/16 wall thickness and are preferably five inches long and constructed of steel. The chains 25 preferably are ⅜ inch thick grade 80 zinc plated steel for corrosion resistance.

Although welding the chain 25 to the lifting bracket 21 is preferred, the chain 25 could also be mechanically fastened to the lifting bracket. A cable can also be used in place the chain 25. The platform 17 on the foot of the lifting bracket 21 preferably has a half circle configuration and a flat surface. The lifting platform preferably is ¼" thick by 3.5 inch wide steel plate and is welded to the top of the foot on the lifting bracket 21. The lifting bracket 21 has an L-shape and is preferably 14 inches long and 1.5 inches wide. The foot of the lifting bracket 21 preferably is five inches long and 1.5 inches wide and is 1.5 inches thick and made of steel or of other suitable material.

The head of the lifting bracket 21 is 3" wide at the top and drops down on the foot side then returns at a 45% angle back to the front of the leg of the lifting bracket 21, which puts the chain 25 over the center of the foot and allows for a straighter up and down lift. The lifting bracket 21 can be made larger or smaller depending upon the desired application. The chain 25 can be welded or mechanically fastened to the top of the lifting bracket 21 and will still lift but is not as safe. If the chain 25 is welded or fastened to the backside of the leg of the lifting bracket 21, the lifting bracket 21 will pull out from in under material or object being lifted and could cause series injury. The back of the lifting bracket 21 head drops down and returns at a 45% angle to the leg of the lifting bracket 21, as this is to be hit with a hammer to remove the lifting bracket 21 after the lifting process is completed.

The platform 17 of the lifting bracket 21 has a dual purpose. As the lifting bracket 21 with platform 17 and chain 25 are raised by the jacks 23 and the sway and lifting tube or bar 22, the lifting bracket 21 has a tendency to pivot as the chain 25 and slip tube lifting bracket 13 adjust under the weight of the concrete slab 26. The platform 17 gives more support area so that the foot of the lifting bracket 21 will not come out from under the concrete slab 26. The second function of the platform 17 is the platform 17 on the lifting bracket 21 can be placed in the center of a crack in a concrete slab 26, and the platform 17 will span and support both sides of the concrete slab 26 during the lifting process. Once the concrete slab 26 has been lifted into the desired position and suspended, the desired base support material 12 can be injected, poured pumped or placed into the void 14 under the concrete slab 26. The support material can be expandable foam from a foam storage source 11, such as Dow Corning Great stuff foam or Fill & Seal. This is done by sliding a plastic tube 10 into the void 14 created under the concrete slab 26 by the lifting system 20 as shown in FIG. 1. The opposite end of the plastic tube 10 is now connected to the source of expandable foam 11, such as by connecting the flexible plastic tube 10 to the output of the output of the source 11 of expendable foam 11 and releasing the expandable foam from the source 11. The pressurized foam in the source 11, such as a can 11, is injected into the void 14 under the concrete slab 26 and allowed to set.

Below are the steps for using the apparatus 20 of the present invention to lift a concrete slab:

At the lowest point of the outside edge of the Concrete Slab to be lifted.

1: With a shovel, in the ground next to edge of concrete dig a hole exposing the bottom of the concrete 26. A user should always check before digging, and check for buried sprinkler lines, pipes and electrical wires.

2: With a hammer hit the Lifting Bracket 21 with chain L end down, below the bottom of the concrete slab 26. The leg of the bracket should be tight against the side of the concrete slab 26.

3: lay the chain 25 down on top of concrete slab 26.

4: on the outside of the L-Lifting Bracket 21, and on the level ground place one of the Jacks 23.

5: Now repeat entire process on the other side of concrete slab 26.

6: Slide the Sway and Lifting Tube or Bar 22 through the slip tubes 19 on the top of the jack 23.

7: Now take Slip Tube Lifting Brackets 13 with Pivot Pivoting Lift Rings 18 facing downward. Now one at a time, slide the Slip Tube Lifting Brackets 13 onto the Sway and Lifting Tube 22.

8: Then slide the sway and lifting tube 22 through the slip tube 19 on the opposite side Jack.

9: Making sure that the sway & lifting tube 22 is directly over the lifting bracket with chain 18 on each side of concrete slab 26.

10: Now slide one of the Slip Tube Lifting Brackets 13 with Pivoting Lift Ring 18, directly over each of the Lifting Brackets 21 with Chains 25.

11: Now place the Chain 25 from the Lifting Bracket 21 through the Pivoting Lift Ring 18 on the Slip Lifting Bracket 13 and pull Chain 25 taught. Now insert the Bolt 24 through the Chain 25 link on each side of the Pivoting Lifting Ring 18 and thread on the Nut finger tight.

12: Raise Jacks 23 buy pumping the handles or Press air valve or turn the nut on the screw 15 on each Jack 23 until the Chain 25 on each Lifting Bracket 21 is taught. Adjust as needed for alignment of Slip Tube Lifting Bracket 13 with Pivoting Lift Ring 18 and the Lifting Bracket 21 with Chain 25. NOTE: Make sure pressure release valve on the Jack 23 is closed or Jack 23 will not raise.

13: Once everything is in alignment. Raise Jacks to lift concrete to it's desired position, and stop. If the position of concrete is not correct lower the concrete and reposition the lifting brackets and try again. This can be done as many times as necessary until desired position is achieved.

14: Now take your Flexible Plastic Extension Tube 10 and cut it to length and place it over the tube on the Can Of Foam 11.

15: Now slide you're Flexible Plastic Extension Tube 10 through the opening next to the Lifting Bracket 21 with Chain, and into the Void Under The Slab 26 that was created by The Lifting System 20.

16: Now through a side opening in the gap between concrete 26 and the ground install your desired base material, pump, pour or inject it. If using Foam, follow the instructions on your can of foam and inject foam 12 under concrete 26 until you can see it start to come out of the hole 14, that the tube 10 is in. Once you see the foam, stop injecting and let material set. Foam 12 can also be injected through any cracks in the concrete that the tube 10 will fit in.

17: The foam that was injected under the concrete will expand and fill voids under the Slab 26. The Foam will also expand out of the holes next to the Lifting Bracket With Chain 21 which is normal.

WARNING!!! Do not Seal off the Holes! If you do the Foam will expand and lift the Concrete Slab higher then desired. If this happens release the pressure on the Jacks slightly to lower Slab back into position. This will only work if the Foam is still soft and has not set.

18: Once the Foam has set under the Concrete Slab 26 release pressure on Jacks 23, remove lifting System 20. Break off or cut off excess harden material 12 and remove. Finally put dirt back in holes surrounding concrete 26 and you're done.

Optional Materials:

19: Dry or wet materials can also be used, such as sand, pea gravel, other aggregate, concrete, self leveling concrete, mortars, grouts, clay, ball mix, or any combinations of dry materials & expandable foam. Wet materials like fast set concrete or grout and expandable foam or self leveling concrete and expandable foam.

20: If the existing ground base material is bad. An impact auger can be used to put small post holes that can be filled with concrete for extra support along the perimeter of the concrete at any desired spacing or angle.

The Lift & Fill process of lifting concrete solves the problem of over lifting, lifting in the wrong spot. If an operator lifts in the wrong spot, the operator just lowers and moved the equipment over until equipment is positioned correctly. Then inject the support material 12. The present invention eliminates excessive labor, excessive material, excessive equipment, material storage and handling, clean up, material availability, excessive training, virtually anybody can be trained to do the job, and is extremely cost-effective. Support material goes in from the side no ugly holes.

Figure 2:
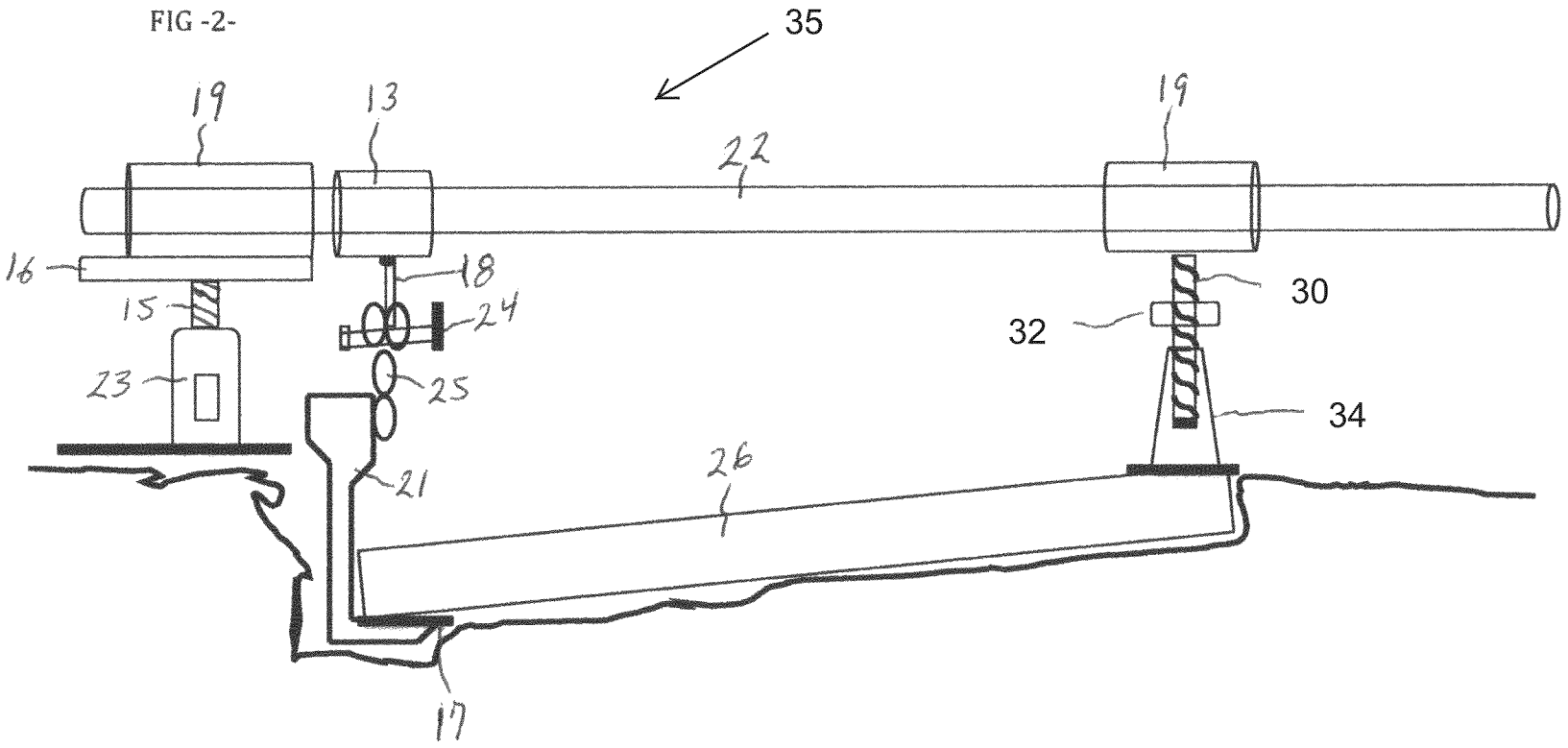
FIG. 2 illustrates a further embodiment of the present invention for lifting one side only of a concrete slab 26.

FIG. 2 illustrates a further embodiment 35 of the present invention for lifting one side only of a concrete slab 26. It included one hydraulic bottle jack 23 with an opposing screw jack stand 34 with stop nut 32 this is to support the sway & lift tube or bar 22. One lifting bracket 21 with platform 17 and chain 25, and nut and bolt 24. One slip tube lifting bracket 13 with pivoting lift ring 18.

Figure 3:
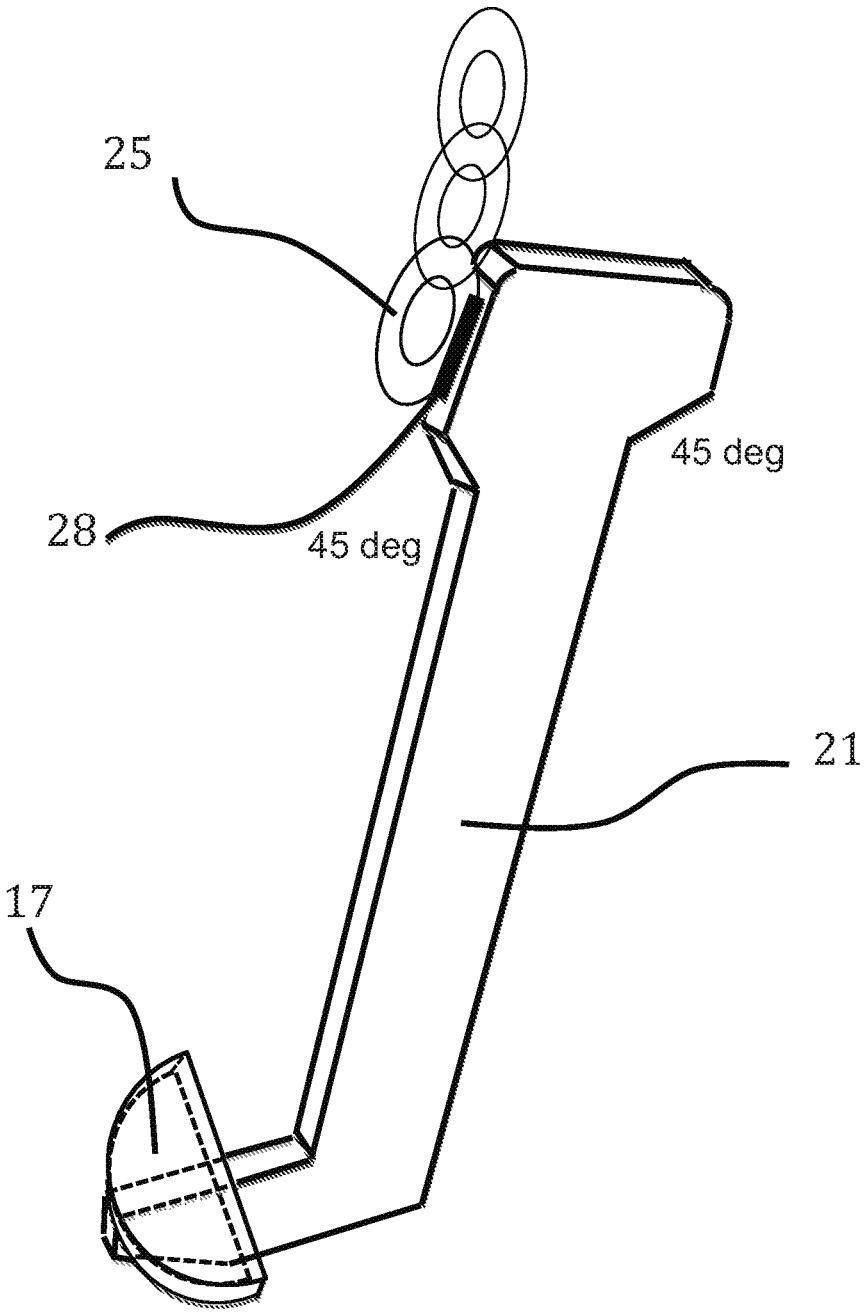
FIG. 3 illustrates the lifting bracket 21 with platform 17 with chain 25 welded 28 to front of leg.
Figure 4:
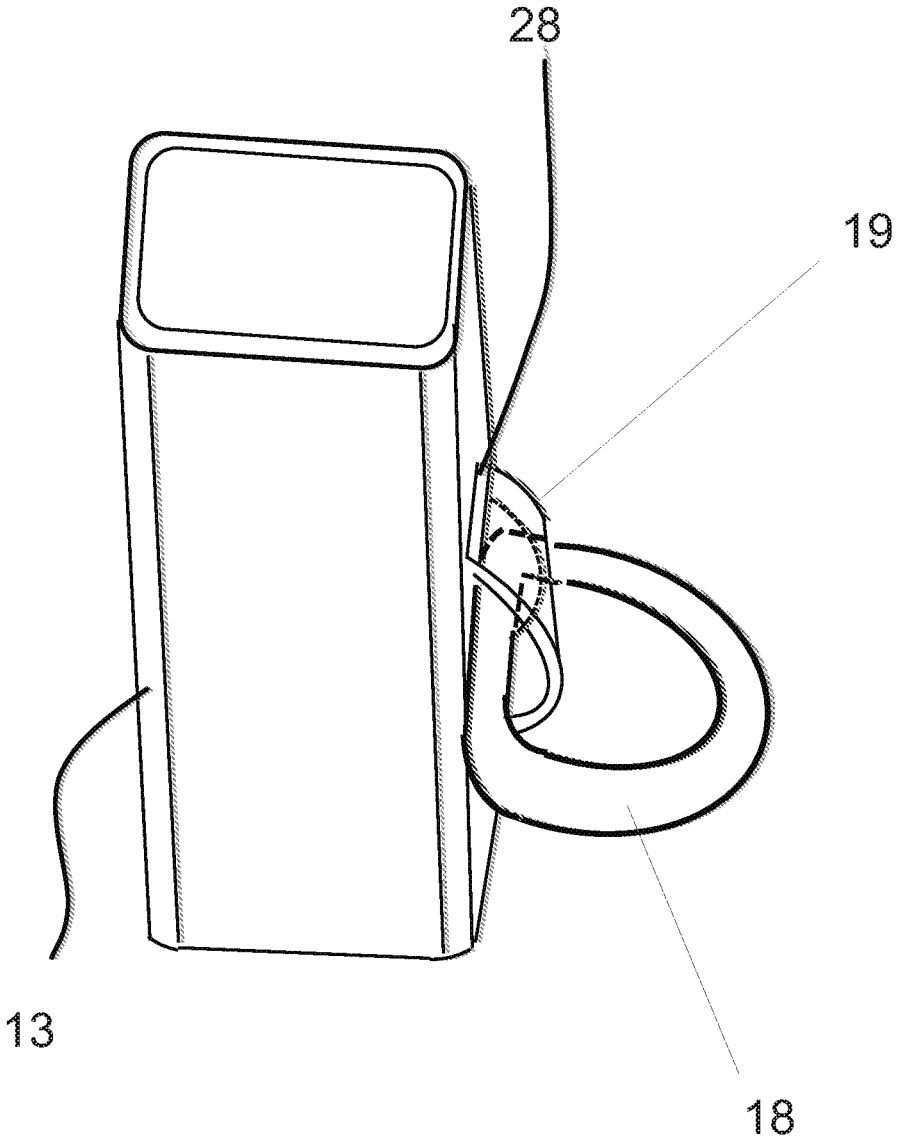
FIG. 4 illustrates the slip tube lifting bracket 13 with pivot lift ring 18 welded to slip tube lifting bracket 13.
Figure 5:
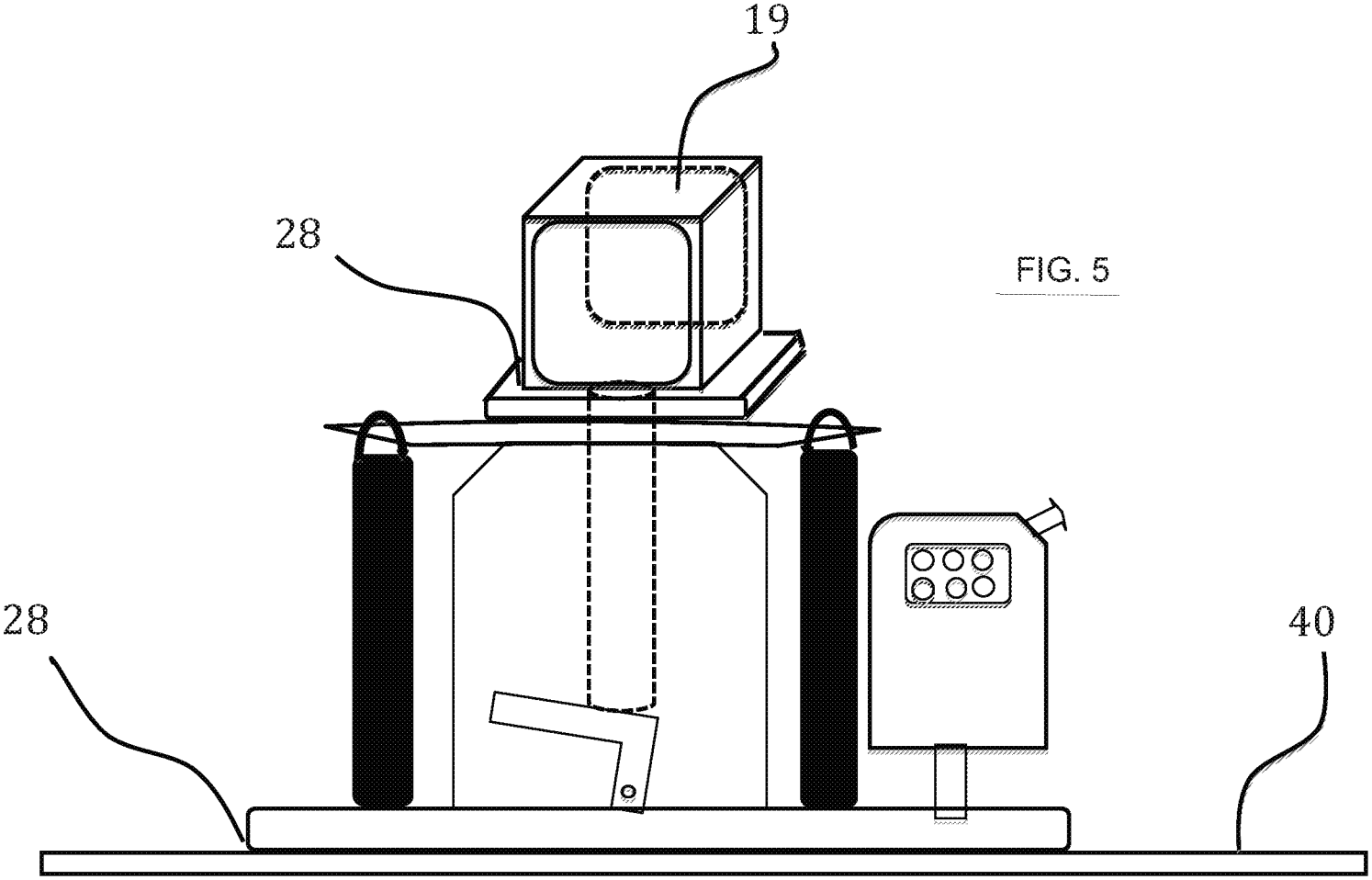
FIG. 5 illustrates the air or hydraulic bottle of Jack 23 welded 28 to enlarged base 12 which is ¼" steel plate or other suitable material for better stability.
Figure 6:
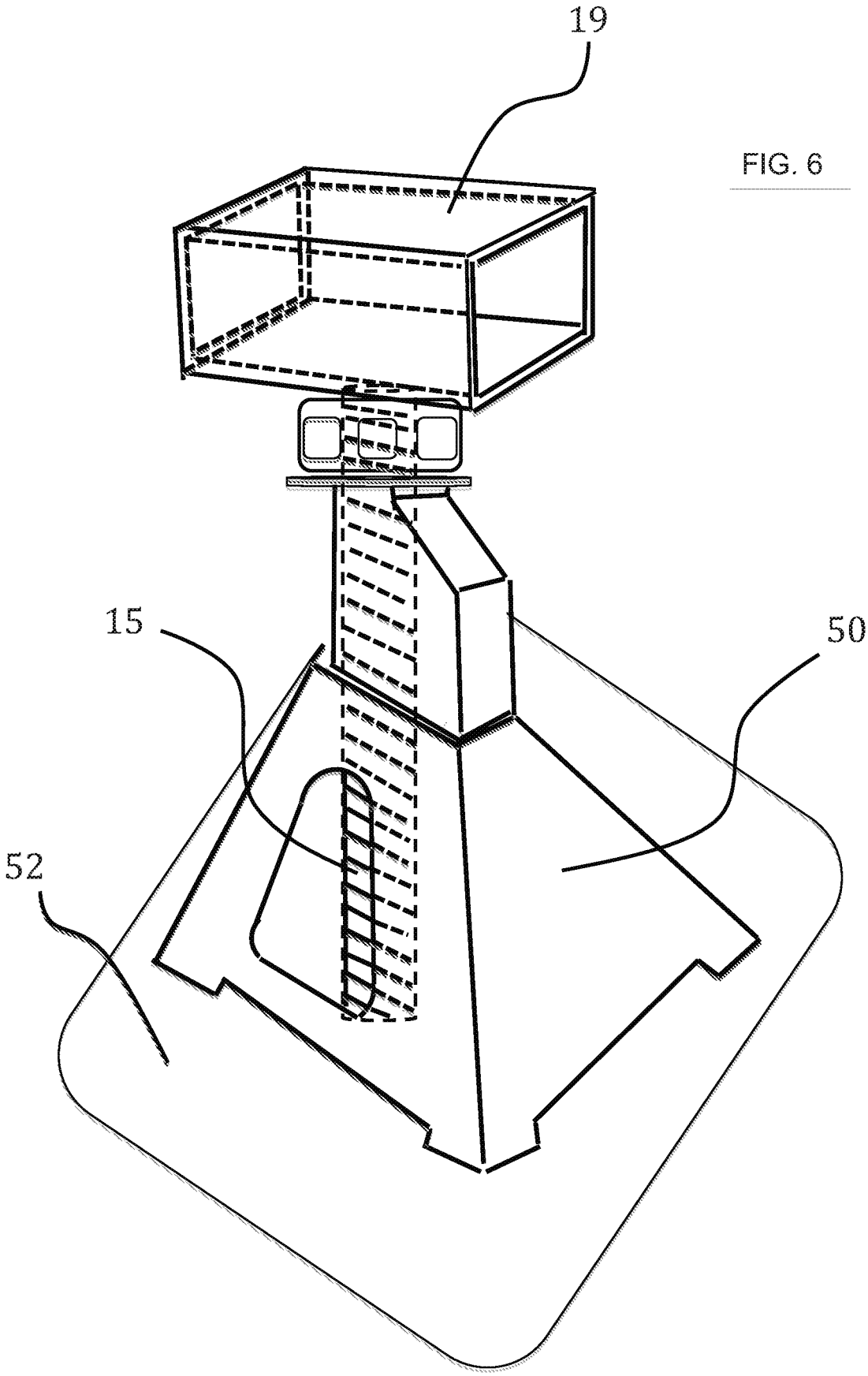
FIG. 6 illustrates the screw jack and stand 11 as seen in FIG. 2 with a slip tube 19 welded to the screw that has a nut which raises and lowers the screw 15.
Figure 7:
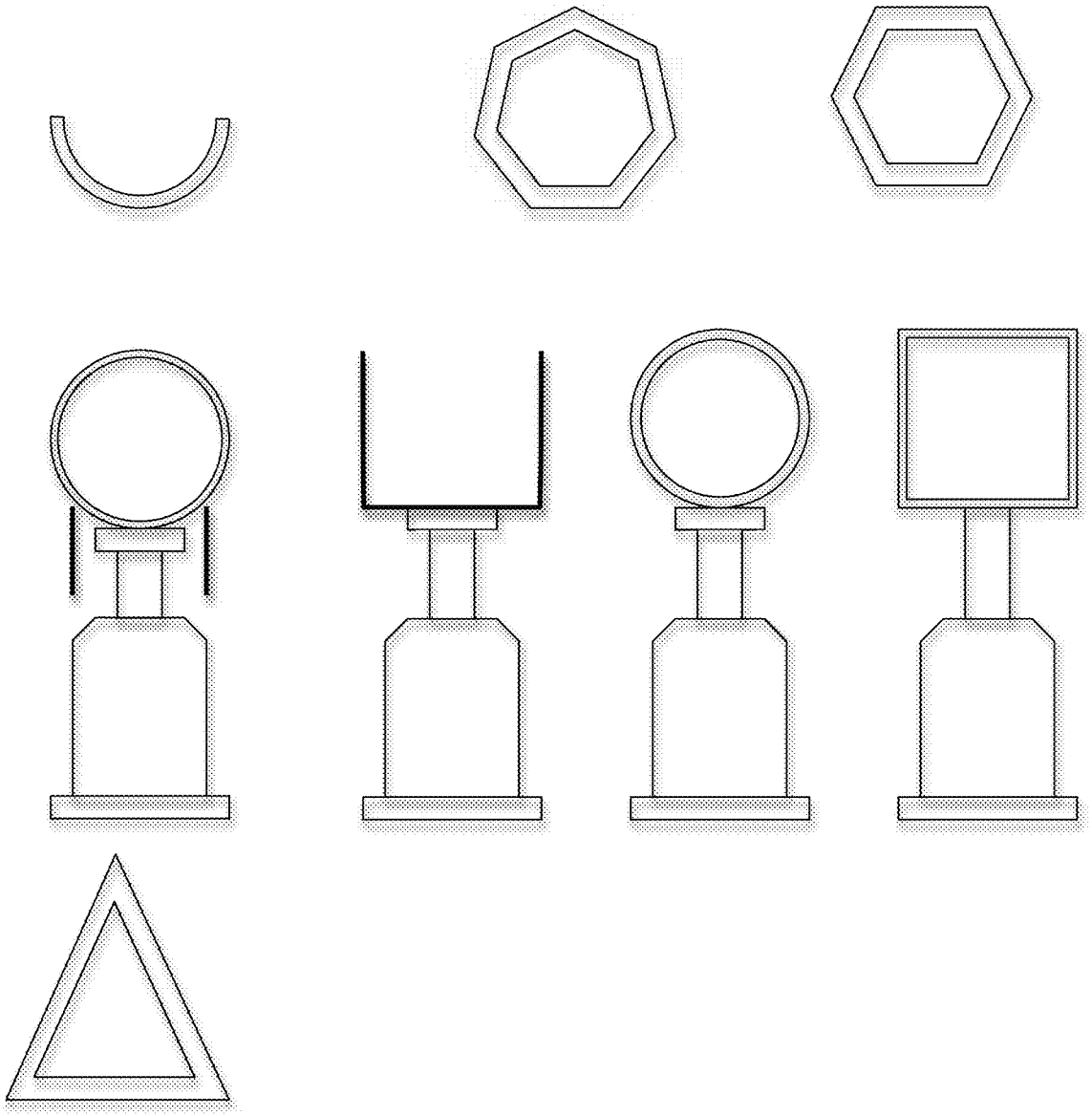
FIG. 7 illustrates just some examples of shapes that could be used as slip tube 19 or saddles 16 mechanically fastened or welded to a jack 23.

FIG. 3 illustrates the lifting bracket 21 with platform 17 with chain 25 welded 28 to front of leg;

FIG. 4 illustrates the slip tube lifting bracket 13 with pivot lift ring 18 welded to slip tube lifting bracket 13;

FIG. 5 illustrates the air or hydraulic bottle of Jack 23 with weld 28 to enlarged base 40 which is ¼" steel plate or other suitable material for better stability. This is preferred, however, as the Jack 23 could be placed on a peace of wood or other material. With a slip tube 19 welded to the saddle 16 that has been welded 28 to the jack screw not visible in this illustration but is seen in FIGS. 1, 2 and 6;

FIG. 6 illustrates the screw jack and stand 50 as seen in FIG. 2 with a slip tube 19 welded to the screw that has a nut which raises and lowers the screw 15. The screw jack and stand 50 has been welded 28 to a larger base 52 for better stability. This is preferred however screw jack 50 could be placed on a peace of wood or other material; and FIG. 7 illustrates just some examples of shapes that could be used as slip tube 19 or saddles 16 mechanically fastened or welded to a jack 23.

While specific embodiments have been shown and described to point out fundamental and novel features of the invention as applied to the preferred embodiments, it will be understood that various omissions and substitutions and changes of the form and details of the invention illustrated and in the operation may be done by those skilled in the art, without departing from the spirit of the invention.

The invention claimed is:

1. A system for lifting a concrete slab, comprising:
a first lifting jack and a second lifting jack;
a first slip tube secured to a top of the first lifting jack;
a second slip tube secured to a top of the second lifting jack;
a lifting bar having a first end extending through the first slip tube and a second end extending through the second slip tube;
a first lifting tube around the first end of the lifting bar between the first slip tube and the second slip tube;
a second lifting tube around the second end of the lifting bar between the first slip tube and the second slip tube;
a first lifting bracket connected to the first lifting tube;
a second lifting bracket connected to the second lifting tube;
an expandable foam storage source; and
a flexible tube connected to the expandable foam storage source for directing foam below a concrete slab to be lifted by the concrete lifting system.

2. The lifting system of claim 1, further comprising:
a first chain connecting the first lifting tube to the first lifting bracket; and
a second chain connecting the second lifting tube to the second lifting bracket.

3. The concrete lifting system of claim 2, wherein the first lifting bracket includes a first platform for supporting a concrete slab, and the second lifting bracket includes a second platform for supporting a concrete slab.

4. The concrete lifting system of claim 3, further comprising:
a concrete slab supported by the first platform and the second platform.

5. The concrete lifting system of claim 3, wherein the first chain is connected to the first lifting bracket directly above the first platform, and the second chain is connected to the second lifting bracket directly above the second platform.

6. The concrete lifting system of claim 2, further comprising:
a first pivoting ring connecting the first lifting tube to the first chain; and
a second pivoting ring connecting the second lifting tube to the second chain.

7. The concrete lifting system of claim 1, further comprising:
a first metal plate connecting the first slip tube to the first lifting jack; and
a second metal plate connecting the second slip tube to the second lifting jack.

8. The concrete lifting system of claim 1, wherein the first lifting jack is an air jack, and the second lifting jack is an air jack.

9. A system for lifting a concrete slab, comprising:
a first lifting jack and a second lifting jack;
a first U-slot secured to a top of the first lifting jack;
a second U-slot secured to a top of the second lifting jack;
a lifting bar having a first end extending through the first U-slot and a second end extending through the second U-slot;
a first lifting tube around the first end of the lifting bar between the first U-slot and the second U-slot;
a second lifting tube around the second end of the lifting bar between the first U-slot and the second U-slot;
a first lifting bracket connected to the first lifting tube;
a second lifting bracket connected to the second lifting tube;
an expandable foam storage source; and
a flexible tube connected to the expandable foam storage source for directing foam below a concrete slab to be lifted by the concrete lifting system.

10. The concrete lifting system of claim 9, wherein the first lifting jack is a hydraulic jack, and the second lifting jack is a hydraulic jack.

11. The concrete lifting system of claim 9, further comprising:
a first chain connecting the first lifting tube to the first lifting bracket; and
a second chain connecting the second lifting tube to the second lifting bracket.

12. The concrete lifting system of claim 9, further comprising:
a first metal plate connecting the U-slot to the first lifting jack; and
a second metal plate connecting the second U-slot to the second lifting jack.

13. The concrete lifting system of claim 9, wherein the first lifting bracket includes a first platform for supporting a concrete slab, and the second lifting bracket includes a second platform for supporting a concrete slab.

14. The concrete lifting system of claim 13, further comprising:
a concrete slab supported by the first platform and the second platform.

15. A lifting system, comprising:
a lifting jack;
a slip tube secured to a top of the lifting jack;
a lifting bar having a first end extending through the slip tube and a second end to be placed upon a fixed location;
a lifting tube around the first end of the lifting bar;
a lifting bracket connected to the lifting tube;
an expandable foam storage source; and
a flexible tube connected to the expandable foam storage source for directing foam below a concrete slab to be lifted by the lifting system.

16. The lifting system of claim 15, further comprising:
a chain connecting the lifting tube to the lifting bracket.

17. A system for lifting a concrete slab, comprising:
a first lifting jack and a second lifting jack;
a first slip tube secured to a top of the first lifting jack;
a second slip tube secured to a top of the second lifting jack;
a lifting bar having a first end extending through the first slip tube and a second end extending through the second slip tube;
a first lifting tube around the first end of the lifting bar, wherein the first lifting tube is comprised solely of a unitary tube;
a second lifting tube around the second end of the lifting bar, wherein the second lifting tube is comprised solely of a unitary tube;
a first lifting bracket connected to the first lifting tube; and
a second lifting bracket connected to the second lifting tube.

18. The concrete lifting system of claim 17, further comprising:
a first chain connecting to the first lifting tube to the first bracket, wherein a first pivoting ring connects the first lifting tube to the first chain; and a second chain connecting to the second lifting tube to the second bracket, wherein a second pivoting ring connects the second lifting tube to the second chain.

19. The concrete lifting system of claim 17, further comprising:

an expandable foam storage source; and a flexible tube connected to the expandable foam storage source for directing foam below a concrete slab to be lifted by the concrete lifting system.

* * * * *